US005950263A

United States Patent [19]

Hanson et al.

[11] Patent Number: 5,950,263

[45] Date of Patent: Sep. 14, 1999

[54] LENGTH EXTENDER FOR CHILD'S WHEELCHAIR SEATING SYSTEM

[75] Inventors: Wayne H. Hanson; Clifford K. Trevillyan, both of Bozeman, Mont.

[73] Assignee: Sunrise Medical HHG Inc., Longmont, Calif.

[21] Appl. No.: 08/967,192

[22] Filed: Oct. 29, 1997

Related U.S. Application Data

[63] Continuation of application No. 08/748,089, Nov. 12, 1996, abandoned.

[51] Int. Cl.[6] ..... A47C 27/15; A47C 7/02

[52] U.S. Cl. ..... 5/653; 5/657; 5/655.9; 297/452.21; 297/452.25; 297/452.27

[58] Field of Search ..... 5/653, 655.9, 657; 297/452.21, 452.25, 452.27

[56] References Cited

U.S. PATENT DOCUMENTS

| | | | |
|---|---|---|---|
| 4,819,288 | 4/1989 | Lowthian | 5/653 |
| 5,286,039 | 2/1994 | Goldman | 5/153 X |
| 5,286,089 | 2/1994 | Goldman . | |
| 5,343,876 | 9/1994 | Rogers . | |
| 5,352,023 | 10/1994 | Jay et al. | 297/452.21 |
| 5,442,823 | 8/1995 | Siekman et al. | 297/452.27 |
| 5,492,823 | 2/1996 | Xu . | |

*Primary Examiner*—Michael F. Trettel
*Attorney, Agent, or Firm*—MacMillan, Sobanski & Todd, LLC

[57] ABSTRACT

A transversely extending insert 20 for adjusting the length of a split level wheelchair support cushion 10, said split level wheelchair support cushion 10 having a raised forward section 12 for supporting a user's femoral region and a lowered rear section 14 for supporting the user's ischial and coccyx region, with a downwardly rearwardly slanting step face 21 separating the raised forward section 14 from the lowered rear section 12, said insert 20 having:

substantially parallel top and bottom surfaces 24 and 22, top surface 24 being co-planar to top surface 17 of raised forward section 14, bottom surface 22 being co-planar with bottom surfaces 13 and 15 of both raised forward section 14 and lowered rear section 12, substantially parallel downwardly rearwardly slanting front and back surfaces 23 and 25, 27, back surface 25, 27 having a horizontally indented ledge surface 26 positioned therealong, ledge surface 26 being co-planar with the top surface 19 of lowered rear section 14.

12 Claims, 3 Drawing Sheets

LENGTH EXTENDER FOR CHILD'S WHEELCHAIR SEATING SYSTEM

This is a continuation, of application Ser. No. 08/748,089 filed Nov. 12, 1996, now abandoned.

TECHNICAL FIELD

The present invention relates to wheelchair seating systems, and more particularly to wheelchair seating systems which are adjustable to accommodate the needs of children as they grow.

BACKGROUND OF THE INVENTION

The proper design of a wheelchair seating system for either an adult or child requires that various locations of the user's body receive different degrees of support. For example, a number of seating systems exist which provide proportionally more support under a user's femoral region, and proportionally less support under a user's ischial tuberosities and coccyx. It is well known to provide support under a user in this manner so as to reduce support pressures on the user's ischial tuberosities and coccyx and distribute the user's weight much more evenly over the entire seating area, thus reducing the danger of the user developing localized pressure sores.

Designing optimal seating systems for child users of wheelchairs therefore presents unique problems for wheelchair seat designers as children constantly change in body size, shape and proportion as they grow. Accordingly, the particular parts of the child's body which require different amounts of support are constantly changing as the child grows. The child's growth also makes it difficult to design a seating cushion which also helps to center and balance the child, without the seating cushion requiring bucketing which becomes somewhat restrictive as the child grows.

One existing system for reducing pressure on a user's ischial tuberosities and coccyx is to provide a split-level support cushion underneath the user with a front raised area underneath the region of the user's femur bones, and a lowered back area at the back of the cushion positioned under the user's ischial tuberosities and coccyx. An example of such a system is found in U.S. Pat. No. 5,352,023 to Jay et al. which discloses a seating and back system for a wheelchair which is adjustable to accommodate the needs of a growing child. In this system, a downwardly rearwardly slanting step face is found between the raised femoral support region and the lowered ischial/coccyx support region of the cushion. The child's ischial tuberosities are preferably positioned against this step face, thus preventing the child from sliding forward along the seating surface, which otherwise would result in posture and spinal curvature problems. Ideally, the back of the child's knees are to be positioned immediately adjacent the front surface of the seating member in roughly a 90 degree orientation, such that the child's legs extend forward along the seating surface and then straight downward. The Jay system adjusts to accommodate the growth of a child by having one or more separate step members which can be inserted so as to move the slanting step face farther to the rear of the seating cushion as the child grows. By having such a step face, the location of which is adjustably movable back and forth, the child's ischial tuberosities can always be positioned against this step face, thus assisting in optimally holding and positioning the child upon the seating surface and avoiding problems caused by the child thrusting or scooting forward on the seat cushion. By moving the slanting step face rearwardly to ensure that the back of the child's knees are kept sufficiently close to the front end of the seat cushion as the child grows, the child's legs can remain angled downwards by 90 degrees in front of the cushion, such that the child's feet can comfortably rest on foot supports.

Unfortunately, some disadvantages remain with the Jay system. For example, the length of the cushion is itself not adjustable. This system, therefore, requires the child to be progressively seated farther and farther back upon the seating cushion as the child grows, to ensure that the back of the child's knees remain proximate the front end of the cushion. This feature of the Jay system requires the slanting step face to be moved farther and farther back along the seating cushion by adding step member inserts as the child grows. This in turn reduces the proportion of total surface area of the seating system which supports the user's ischial tuberosities/coccyx region, and increases the proportion of support area under the user'femoral region. The Jay system further necessitates an adjustable back system, which is movable backwards and forwards as required to maintain the proper substantially vertical alignment in the child's back.

OBJECTS OF THE INVENTION

Accordingly, it is an object of the present invention to provide an adjustable system for correctly maintaining the positioning of a child upon a wheelchair seat cushion as the child grows, such that the length of the seating cushion can be easily adjustable.

It is another object to provide an adjustable wheelchair seat cushion for children such that the child can remain seated relatively centered between the front and back ends of the cushion as the child grows.

It is yet another object to provide a wheelchair seating cushion which both prevents the child from sliding forward along the surface of the cushion and also does not become restrictive or uncomfortable as the child grows.

It is another object to provide an adjustable wheelchair seat cushion for children such that the back of the child's knees can remain proximate the front end of the cushion as the child grows.

It is yet another object to provide an adjustable wheelchair seat cushion for children which maintains relatively the same surface area ratios between a raised femoral support region and a lowered ischial/coccyx support region as the child grows. Specifically, it is an object to provide proper support under the full length of the child's femoral region as the child grows, without having to reduce the proportion of surface area of the seating cushion available to support the child's ischial/coccyx region.

Yet another object of the present seating system is to provide an adjustable seating cushion for child wheelchair users which is not required to be operated in conjunction with a separately adjustable wheelchair back system.

It is another object of the present system to provide a child with proper leg, pelvic and spine positioning when using the present system.

Additional objects and features of the present invention are revealed in the Best Mode of Carrying Out the Present Invention and accompanying Figures.

DISCLOSURE OF THE INVENTION

The present invention comprises a transversely extending insert for adjusting the length of a split level wheelchair support cushion, the split level wheelchair support cushion having a raised forward section for supporting a user's femoral region and a lowered rear section for supporting the user's ischial and coccyx region, with a downwardly rearwardly slanting step face separating the raised forward section from the lowered rear section, the insert having:

substantially parallel top and bottom surfaces, the top surface being co-planar to the top of the raised forward section, the bottom surface being co-planar with the bottom surfaces of both the raised forward section and the lowered rear section, and substantially parallel downwardly rearwardly slanting front and back surfaces, the back surface having a horizontally indented ledge surface positioned therealong, the ledge surface being substantially co-planar with the top of the lowered rear section.

BEST MODE OF CARRYING OUT THE INVENTION

Figure 1:
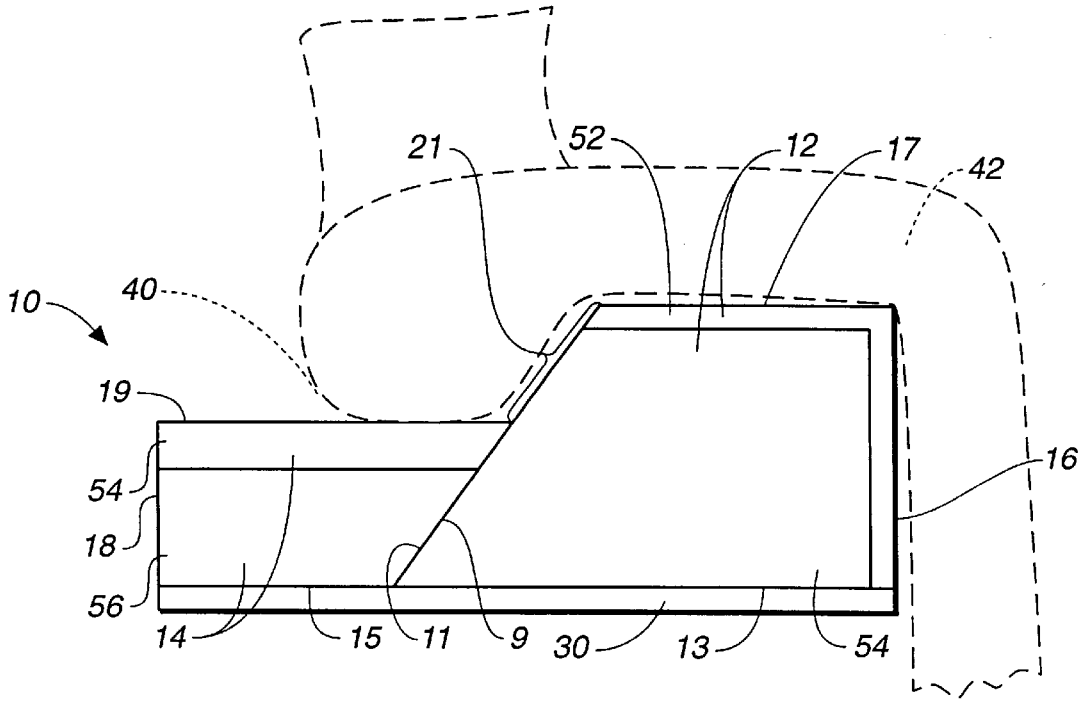
FIG. 1 shows a side view of the seating system of the present invention before the present growth insert is inserted, and with the legs of a child seated thereon shown in phantom.

Designing wheelchair seating systems for children is typically complicated by the growth of the children which changes their relative balance and positioning upon the seating cushion. As their legs lengthen, it typically becomes difficult to provide an adjustable seating system such that the proper amounts of support are provided to each of the various regions of the child's seating area. A common design of wheelchair seating systems exists having a raised front area to support the user's femoral region, and a lowered back area positioned underneath the user's ischial/coccyx region. In trying to adapt such a support cushion for a child's use, it is typically necessary to have the child progressively sit farther and farther back upon the support cushion as the child grows. This is necessary so that the back of the child's knees can remain proximate the front of the seating cushion. It is also necessary so that the child's femoral region receives sufficient support along its full length thereby relieving any excess pressure buildup under the child's ischial tuberosities and coccyx. However, the progressive backwards positioning of the growing child seated upon the seating cushion changes the ratio of surface areas between the raised femoral support region and the lowered ischial/coccyx support region, tending to decrease the amount of support under the child's ischial/coccyx region.

The present invention overcomes these above limitations and offers many additional advantages by providing an insert member 20 for use with a split-level adjustable seating cushion, generally designated 10. Split-level seating cushion 10, as shown in FIGS. 1,2 3 and 4 is comprised primarily of two support regions including a raised forward support 12, and a lowered rear support 14. These supports 12 and 14 are preferably made from a comfortable sponge-type supporting material. Raised forward support 12 is preferably composed of a thin upper sponge-type layer 50 and a lower sponge-type layer 52, where layer 52 is somewhat stiffer than layer 52 thus providing added comfort to the child. Layer 50 may also extend down along front end 16 to provide added comfort to the back of the child's legs. Raised forward support 12 is positioned at the front of the seating cushion, and is adapted to support the child's femoral region. Lowered rear support 14 is preferably composed of a thin upper sponge-type layer 54 and a lower sponge-type layer 56, where layer 54 is somewhat stiffer than layer 56, thus providing added comfort to the child. Lowered rear support 14 is positioned at the back of the seating cushion and is adapted to support the child's ischial/coccyx region. This split-level arrangement provides additional support to the child's femoral region such that, when seated upon the seating cushion, the amount of pressure on the child's ischial tuberosities and coccyx will be substantially reduced, thereby substantially reducing the danger of localized pressure sore formation at these natural pressure points.

As can be seen in FIG. 1, raised forward support 12 and lowered rear support 14 of seating cushion 10, when mated together, have bottom surfaces 13 and 15 respectively which are substantially co-planar. Specifically, raised forward support 12 has a slanted back end 11, and lowered rear support 14 has a slanted front end 9. Ends 9 and 11 are preferably held together by a hook and loops fastener or layer therebetween. Top surfaces 17 and 19 are horizontally parallel, but these surfaces, as is clearly shown, are not co-planar. Rather, a slanting step face 21 on raised forward support 12 is formed between top surface 17 and top surface 19. A child's ischial tuberosities 40 are positioned over rear support 14 such that they rest up against slanting step face 21. Slanting step face 21 thereby provides resistance to forward sliding movement of the child's ischial bones and thereby prevents the child from being able to thrust or scoot forward over the surface of seating cushion 10. The child's knees 42 are positioned proximate the front end 16 of raised forward support 12 such that knees 42 form generally a 90 degree angle, with the child's legs extending directly downward in front of the seating cushion.

As the child grows, and their legs lengthen, (and in the absence of the other alternatives which are herein disclosed), the child will be forced either to sit progressively farther back upon the seating cushion, (as is necessary in the Jay U.S. Pat. No. 5,352,023 system) or they will tend to have their knees extending farther and farther forward from front end 16. Both of these seating problems could conceivably occur simultaneously. Both of these problems are undesirable, each for different reasons. For example, seating the child farther and farther back upon the seating cushion just to keep their knees proximate front end 16 would remove the necessary contact occurring between the child's ischial tuberosities 40 and the slanting step face 21. This would in turn no longer provide proper support necessary to hold the child in a proper position The child would thereby be allowed to freely slide forward, which could change the curvature of the child's spine. One way to avoid this problem would be to have the slanting step face itself adjustably movable backwards as the child grows, (as was necessary in the Jay U.S. Pat. No. 5,352,023 system). The problem with this approach is that it proportionally reduces the surface area of lowered rear support 14 with respect to the surface area of raised forward support 12. This progressively shrinks the surface region of the cushion used to support the child's ischial bones and coccyx as the child grows. The alternate approach of keeping the child's ischial tuberosities at the same position on the seating cushion and simply allowing the child's knees to move farther away from front end 16 causes two problems. First, less of the child's total femoral region is able to be supported by the raised forward support 12, as a greater portion of the child's femoral region would thereby extend forward of the seating cushion. As such, a greater and typically undesirable percentage of the child's weight would tend to be supported instead directly by the child's ischial bones and coccyx. Secondly, the angle of the child's knees would progressively rotate to angles of less than 90 degrees with the child's legs being swept back to rest upon foot supports. This orientation of the child's legs may tend to cause strain on the knee joints and make it more difficult for the child's feet to rest on the footrests of the wheelchair.

Figure 2:
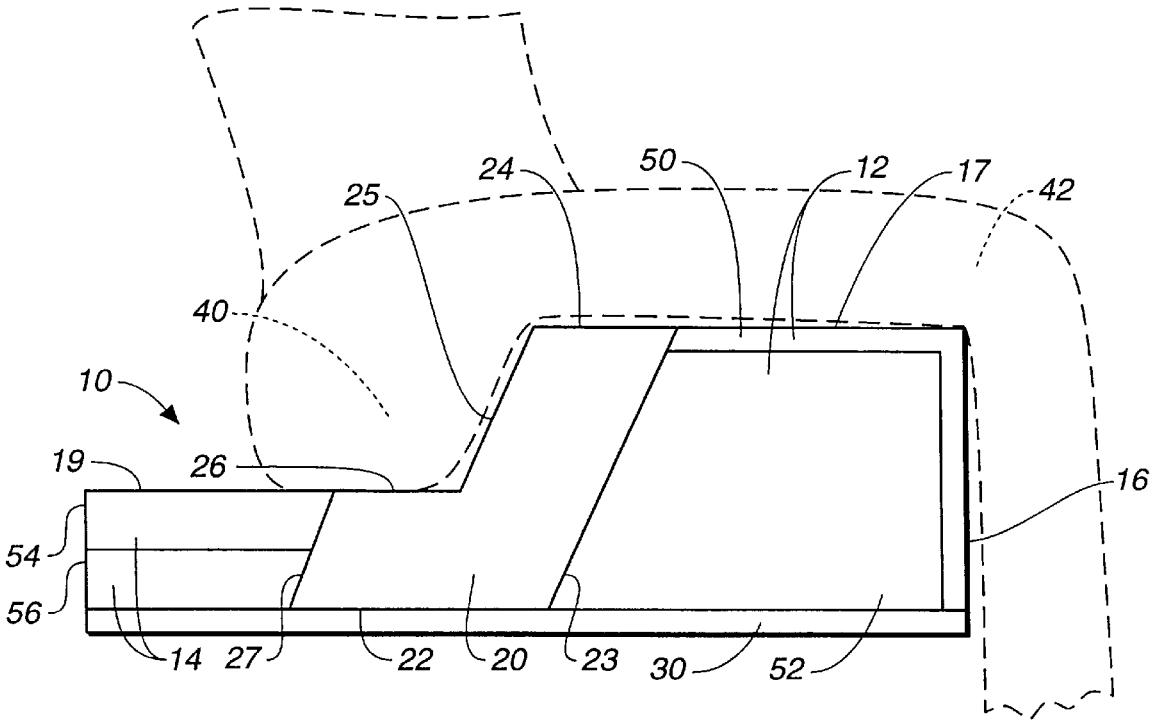
FIG. 2 shows a side view of the seating system of the present invention with the growth insert positioned therein, and with the legs of a child seated thereon shown in phantom.
Figure 3:
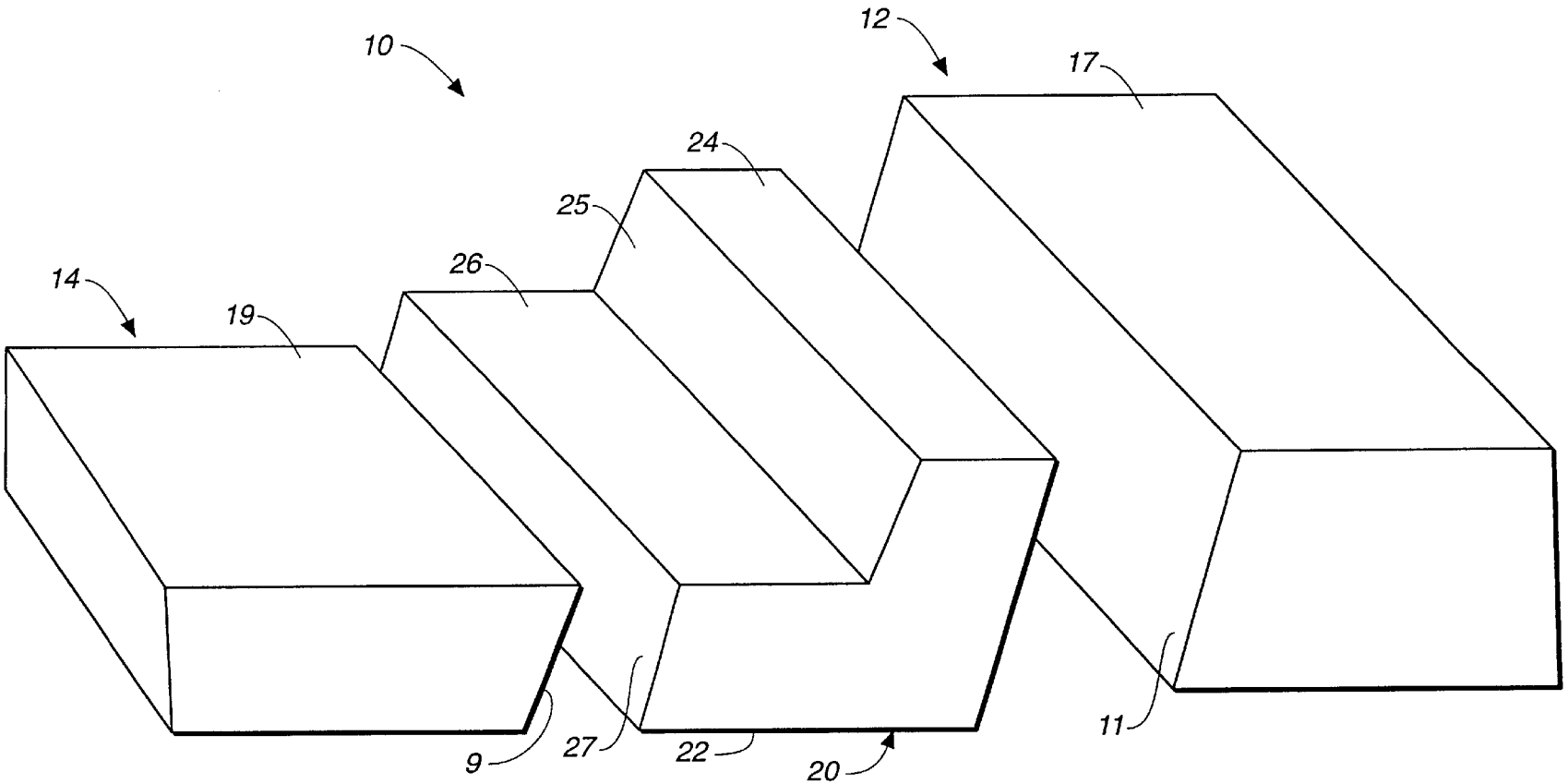
FIG. 3 shows a rear exploded perspective view of the seating system of the present invention with the growth insert positioned therein and with adjustable pelvic well wedges removed.

As is seen in FIGS. 2 and 3, insert 20 has a bottom surface 22, a front surface 23, a top surface 24, an upper back surface 25, a ledge 26 and a lower back surface 27. The use of present insert 20, as seen in FIG. 2 and 3, provides a system for easily adjusting a child's split-level wheelchair seating cushion having a downwardly rearwardly slanting step face to accommodate the growth of a child such that the length of the cushion can be extended as the child grows. Insert 20 is designed to be easily insertable between raised forward support 12 and lowered rear support 14. Accordingly, when a child grows, they will begin by sitting upon the seating system as is shown in FIG. 1 and as they grow, insert 20 will be positioned between raised forward support 12 and lowered rear support 14 so that the child will be sitting upon the seating system as is shown in FIG. 2. Preferably, ends 9 and 11 will be attached to front and lower back surfaces 27 and 23 respectively by VELCRO-type fasteners.

Insert 20 is preferably provided in a variety of sizes such that different sized inserts can progressively be added to seating cushion 10, lengthening it to greater and greater lengths as necessitated by the growth of the child. Keeping within the scope of the present invention, insert 20 may also be composed of a plurality of pieces, fitting together so as to afford the same shape as insert 20.

An important feature of the present insert 20 is that by having its top surface 24 co-planar with top surface 17 of raised forward support 12 and its ledge 26 co-planar with top surface 19 of lowered rear support 14, insert 20 acts to add surface area to both the femoral support region 12 and the ischial/coccyx support region 12 of the seating cushion. By adding surface to both of these support regions as the child grows, the ratio of the size of these two surface areas remains relatively constant as the seating cushion is lengthened. This feature offers several advantages. First, it keeps the growing child relatively centered between the front and back ends of the cushion. This affords the child proper balance and proper leg, pelvic and spine positioning on the wheelchair as they grow, since the relative amounts of support provided by the two main support regions of the wheelchair will remain constant. Secondly, the present insert 20 adds surface area to the seating cushion without effectively moving the feature of a slanting step face backwards from its original location. When inserted, the slanting step face 21 will effectively be replaced by upper back surface 25 as the contact point against the child's ischial tuberosities 40. By keeping a slanting step face (25, not 21 when insert 20 is placed into cushion 10), centered on the cushion, this avoids having the child sit farther and farther back upon the surface of the seating cushion as the child grows since the length of the seating cushion extends both forward and backward from the slanting step face when insert 20 is positioned in cushion 10. This substantially reduces the need for an additional adjustable back system to be used in conjunction with the present invention to correctly position and support the child. Keeping slanting step face 21 centered on cushion 10 also serves to prevent the child from sliding forward along the surface of cushion 10 as the child's ischial tuberosities will be restrained by the slanting step face of upper back surface 25. As the use of insert 20 will not substantially change the central location of a slanting step face, the present system has the added benefits of keeping the child's knees proximal the front end 16 of seating cushion 10 while also maintaining the relative size ratio between the raised femoral support region 12 and the lowered ischial/coccyx support region 14.

One or more seat stiffeners 30 (also seen in FIG. 4) can be positioned to run across bottom surfaces 13 and 15 to provide further structural support to the seating cushion. These seat stiffeners 30 are preferentially made of a VELCRO-type fastener which prevents separation between the blocks of sponge-type material forming lower support region 12 and raised support region 14 in FIG. 1 and also with insert 20 as shown in FIG. 2. Preferably all of parts 12, 14, 20 and 30 are together and received into a neoprene cover (not shown) providing further comfort and moisture protection.

Figure 4:
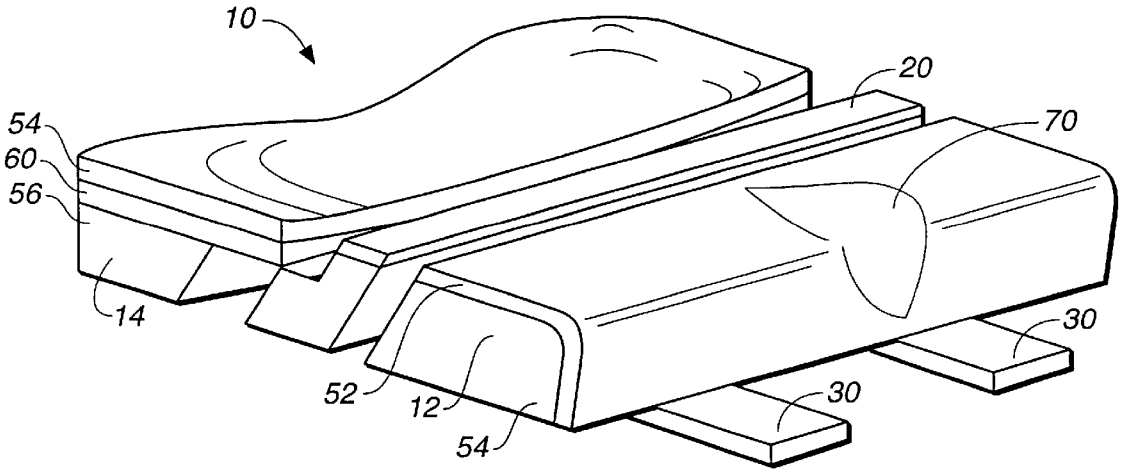
FIG. 4 shows a front exploded perspective view of the seating system of the present invention with the growth insert positioned therein and with adjustable pelvic well wedges positioned therein.

As is seen in FIG. 4, an adjustable pelvic well wedge 60 can be inserted between layers 56 and 54 of raised support region 14, slightly raising the lateral edges of raised support region 14, to bucket and provide lateral support to a child seated upon seating cushion 10. An abductor 70 can also be formed into raised support region 12 to assist in separating the child's legs and correctly positioning the child.

What is claimed is:

1. A transversely extending insert for adjusting the length of a split level wheelchair support cushion, said split level wheelchair support cushion having a raised forward section for supporting a user's femoral region and a lowered rear section for supporting the user's ischial and coccyx region, with a downwardly extending step face separating the raised forward section from the lowered rear section, said insert having:

top and bottom surfaces, the top surface being substantially at the level of the top of the raised forward section, the bottom surface being substantially co-planar with the bottom surfaces of both the raised forward section and the lowered rear section, and downwardly extending front and back surfaces formed to engage the raised forward section and lowered rear section, the back surface having a horizontally indented ledge surface positioned therealong, said ledge surface being substantially co-planar with the top of the lowered rear section.

2. The transversely extending insert of claim 1, wherein, the step face is downwardly and rearwardly slanting, the top surface of the insert is co-planar with the top of the raised forward section, the front and back surfaces of the insert are downwardly and rearwardly slanting and substantially matingly engage a back end of the raised forward section and a front end of the lowered rear section; and the insert is positioned between the raised forward section for supporting a user's thighs and the lowered rear section for supporting a user's ischial tuberosities and coccyx.

3. A split level seat cushion comprising:

a raised forward section for supporting the femoral region, a lowered rear section for supporting the ischial and coccyx region, the forward section having a back surface and the rear section having a front surface, the back surface and front surface adapted to cooperatively engage each other giving the seat cushion a first depth approximately equal to the combined depths of the forward section and the rear section, the forward section having a height greater than the rear section, so that when the forward and rear sections mate, a portion of the back surface of the forward section is above the rear section, creating a step face, and an insert extending transversely and in a depth dimension and having a front surface adapted to cooperatively engage the back surface of the forward section, and a back surface adapted to cooperatively engage the front surface of the rear section, the insert having a stepped rearwardly facing surface with a horizontally indented ledge that substantially aligns with the top surface of the rear section, whereby with the transversely extending insert positioned between the forward section and the rear section, the seat cushion has a second depth approximately equal to the combined depths of the front section, the rear section and the insert.

4. The seat cushion as defined in claim 3 wherein, the back surface of the forward section, the forward surface of the rear section and front surface and the back surface of the insert are all substantially parallel and slant rearwardly and downwardly.

5. A wheelchair cushion assembly comprising:

a front cushion member having a relatively raised front section for support of a user's femoral region thereon and having a rear surface;

a rear cushion member having a relatively lowered rear section for support of a user's ischial and coccyx region thereon and having a front surface formed to cooperatively engage the rear surface of the front cushion member;

a vertically extending step face provided on one of the front cushion member and the rear cushion member, the step face being oriented to face away from a front end of the cushion assembly; and an insert cushion member having front and rear surfaces adapted to cooperatively engage the rear surface of the front cushion member and front surface of the rear cushion member and formed for positioning between the front cushion member and the rear cushion member to effect both an increase of the overall length of the cushion assembly and a repositioning of the vertically extending step face from one of the front end and the rear end of the cushion assembly.

6. The wheelchair cushion assembly as defined in claim 5 wherein, the rear surface of the front cushion member and the front surface of the rear cushion member matingly engage each other.

7. The wheelchair cushion assembly as defined in claim 6 wherein, the front surface on the insert member matingly engages the rear surface on the front cushion member, and the rear surface on the insert member matingly engages the front surface on the rear cushion member.

8. The wheelchair cushion assembly as defined in claim 5 wherein, the step face is downwardly and rearwardly slanting.

9. The wheelchair cushion assembly as defined in claim 5 wherein, the step face is provided on the front cushion member by the rear surface of the front cushion member.

10. The wheelchair cushion assembly as defined in claim 9 wherein, the rear surface of the front cushion member is downwardly and rearwardly slanting.

11. The wheelchair cushion assembly as defined in claim 10 wherein, the rear surface of the front cushion member, the front surface of the rear cushion member, and the front surface and rear surface of the insert member all are downwardly and rearwardly slanting at about the same angle for mating engagement.

12. The wheelchair cushion assembly as defined in claim 5 wherein, the insert member is adapted to move the step face rearwardly from the front end of the cushion assembly.

* * * * *